US007451804B2

(12) United States Patent
Peterson

(10) Patent No.: US 7,451,804 B2
(45) Date of Patent: Nov. 18, 2008

(54) METHOD AND APPARATUS FOR HORIZONTAL CONTINUOUS METAL CASTING IN A SEALED TABLE CASTER

(76) Inventor: Oren V. Peterson, 1250 W. 2600 North, Pleasant Grove, UT (US) 84062

( * ) Notice: Subject to any disclaimer, the term of this patent is extended or adjusted under 35 U.S.C. 154(b) by 0 days.

(21) Appl. No.: 11/562,598

(22) Filed: Nov. 22, 2006

(65) Prior Publication Data

US 2008/0115906 A1 May 22, 2008

(51) Int. Cl.

| | |
|---|---|
| ***B22D 11/06*** | (2006.01) |
| ***B22D 27/04*** | (2006.01) |
| ***C21C 7/06*** | (2006.01) |
| ***C21C 7/064*** | (2006.01) |
| ***C21C 7/068*** | (2006.01) |

(52) U.S. Cl. ..... 164/76.1; 164/479; 164/122.1; 75/528; 75/560

(58) Field of Classification Search ..... 164/76.1, 164/122.1, 478; 75/500–503, 517, 528, 560
See application file for complete search history.

(56) References Cited

U.S. PATENT DOCUMENTS

| | | | |
|---|---|---|---|
| 3,512,574 | A | 5/1970 | Taylor |
| 3,598,175 | A | 8/1971 | Olsson et al. |
| 3,753,459 | A | 8/1973 | Burkhardt et al. |
| 3,837,392 | A | 9/1974 | Rossi |
| 3,848,656 | A | 11/1974 | Meylan |
| 3,897,906 | A | 8/1975 | Bachner |
| 3,934,641 | A | 1/1976 | Chielens |
| 3,948,311 | A | 4/1976 | Sylvester |
| 4,036,281 | A | 7/1977 | Rossi |
| 4,047,985 | A | 9/1977 | Greenberger |
| 4,443,272 | A | 4/1984 | Katoh et al. |
| 4,494,594 | A | 1/1985 | Kurzinski |
| 4,716,954 | A | 1/1988 | Ardito et al. |
| 4,751,960 | A | 6/1988 | Naveau et al. |
| 4,765,390 | A | 8/1988 | Vaterlaus |
| 4,815,519 | A | 3/1989 | Chielens |
| 4,981,531 | A | 1/1991 | Katoh et al. |
| 5,452,756 | A | 9/1995 | Ohatake et al. |
| 5,716,510 | A | 2/1998 | Lorento |
| 6,250,370 | B1 | 6/2001 | Tada et al. |
| 6,318,449 | B1 | 11/2001 | Jolivet et al. |

(Continued)

*Primary Examiner*—Kuang Lin
(74) *Attorney, Agent, or Firm*—Haight Law Office

(57) ABSTRACT

A method and apparatus for preparing and delivering various types of carbon and microalloy steel, free of oxygen with abundance of nuclei, when cast producing ultra fine grain steel free of internal defeats with excellent quality. A horizontal sealed table caster has a chamber, containing a suitable atmosphere for casting, with a tube connecting to a tundish so as to allow a liquid to flow into the chamber. The liquid metal is captured on a cooling belt along the bottom of the chamber and is maintained as a specific width and depth. The cooling belt serves as a heat sink causing the liquid metal to solidify from the bottom up, allowing inclusions to migrate to the surface of the steel. A layer of liquid metal is maintained on top of the solidifying steel until the solidification reaches the surface. The belt moves the solid metal toward the exit of the chamber. As the liquid metal solidifies, the impurities migrate in the liquid metal, reaching the surface and a solid metal body free of inclusions with the superior properties is produced.

3 Claims, 7 Drawing Sheets

U.S. PATENT DOCUMENTS 6,328,093 B1 12/2001 Zajber et al.
6,390,177 B1 5/2002 Arvedi et al.
6,585,799 B1 7/2003 Zeze et al.
6,918,969 B2 7/2005 Zeze et al.
2003/0015260 A1* 1/2003 Zeze et al. ..... 148/541

* cited by examiner

METHOD AND APPARATUS FOR HORIZONTAL CONTINUOUS METAL CASTING IN A SEALED TABLE CASTER

CROSS REFERENCE TO RELATED APPLICATIONS

This application uses the liquid steel produced as disclosed in patent application Ser. No. 11/070,527 filed Mar. 1, 2005, by Oren V. Peterson, entitled "Thermal Synthesis Production of Steel" which application is hereby incorporated by reference herein in its entirety with the following exception: In the event that any portion of the above-referenced application is inconsistent with this application, this application supercedes said above-referenced application.

FEDERALLY SPONSORED RESEARCH OR DEVELOPMENT

Not applicable.

SEQUENCE LISTING OR PROGRAM

Not applicable.

BACKGROUND—FIELD OF INVENTION

The present invention relates generally to Casting of steel. More particularly, the present invention relates to metal casting where the steel is horizontally cast and cooled on one side from the bottom minimizing the inclusions of formation of impurities in the steel by increasing negative segregation and also producing steel that has fine grained equal axial structure.

BACKGROUND—PRIOR ART

Until now, cast steels have been produced by casting molten steel (consisting mainly of reduced iron oxide) into slabs, blooms, billets and cast strips, etc. through ingot casting methods using fixed molds and through continuous casting methods using slip molds, belt casters and strip casters, etc. and by cutting them into prescribed sizes.

Continuous casting of steel has been achieved by pouring liquid steel in a vertical mold and extracting the steel from the bottom of the mold after solidification is completed. Continuous casting of steel has great advantages over fixed volume mold castings. The rate of liquid steel flow into the mold, the cooling rate of the steel, and the migration and segregation is near constant resulting in near 100% yield. Furthermore, the surface texture of the steel is excellent. One disadvantage of vertical continuous steel casting is the positive segregation that occurs in the interior of the casting. This positive segregation generally results in inclusions and lower steel quality. Many patents have improved the quality of steel produced from continuous casting—for example U.S. Pat. Nos. 6,585,799 (2003) and 6,918,969 (2005) both to Zeeze et a.—but none similar to the Sealed Table Caster.

During continuous steel casting the nature of the change from a liquid to solid phase is critical. At this moment physical and chemical conditions occur that will determine many mechanical properties and surface finish of the steel. These properties are related to the crystalline granular structure of the steel. The crystalline granule structure is determined by (1) keeping the difference in the temperature between liquid steel and the solidified steel to a minimum, (2) inducing flow or movement of the liquid steel across the solidifying dendrite, thus maintaining a consistent solution chemically and physically (3) insuring the high frequency of nuclei in the molten steel, and (4) allowing negative segregation to continue through the final solidification of the steel and eliminating inclusions. These factors are important in the formation of a high quality steel.

At freezing point the liquid steel begins to solidify, crystalline structure form around the nuclei, the smallest aggregate of atoms on a crystalline lattice. Immediately dendrites crystalline lattice form having a periodicity that produces a long range order. Each dendrite grows until encountering other dendrites thus forming grain boundaries. The dendrite continues to grow in their precise cubic cell crystalline periodicity rejecting impurities in their growth. This rejection educes negative segregation accompanying the solidification of the steel.

During the solidification process segregation occurs. Negative segregation is the process of the impurities migrating transversely, perpendicular from the heat sink, and as the solidification in the liquid portion of the steel continues. Positive segregation is the accumulation of impurities in the confined liquid portion of the steel. Impurities collect in the liquid portion of the steel. This process is similar to the formation of sea ice and brine pockets. When sea ice dentrites form, the salt in the water is rejected in a process called brine rejection. As a result no salt is formed in the dentrites but is pushed into pockets of highly concentrated brine.

In conventional continuous casting methods, as the steel solidifies the volume of liquid steel decreases and the impurities are concentrated in the void at the center of the casting. This creates defects in the center portion of the casting. For this reason vertical continuous casting methods result in a uniform quality along the steel but not transversely. There is also a tendency of porosity (pore grain bonding structure) and sometimes lamination at the center of the casting resulting from the rejection of impurities and positive segregation maturing to reverse negative segregation.

As solidification takes place in the casting it is accompanied by segregation. The first parts of the casting that becomes solid are purer than the original liquid steel. This is the result of negative segregation (the impurities migrating away from the solid steel). Some elements and compounds are rejected from the crystalline structure as the solid is formed. The remaining liquid is richer in these rejected elements and compounds than was in the original liquid steel. This is called positive segregation. The preciseness of the crystalline structure may become overwhelmed in rejecting impurities and may now allow the impurities to be assimilated in the interstices of the grain boundaries as the impurities increase with positive segregation and solidification progresses. Negative segregation enhances the quality of the steel whereas positive segregation deteriorates the quality of the steel.

In fixed mold casting the impurities in the liquid steel, may to a degree, migrates to the upper region of the ingot as solidification takes place at the bottom. The upper region of the ingot has accumulated a great portion of the impurities through segregation and circulation and buoyancy of the impurities. Consequently the lower section of the ingot usually has the higher quality of steel. Because the upper section has a high concentration of impurities the excess of the provision is usually cropped off and rejected during the slab rolling procedure.

In the prevailing continuous casting, positive segregation at the center of the casting is a consequence of the negative segregation which precedes it from the heat sink of the casting and intensifies as the opposing solidifying locations meet.

Positive segregation deteriorates the quality of the steel in the central portion of the casting. The trend has been to abrogate both negative and positive segregation by assimilating the impurities in the grain boundaries through increasing the grain boundaries area by creating a finer grain steel. This impedes migration of the impurities to the center of the casting, reducing positive segregation, this assimilation deteriorates what may have been the overall integrity of the steel.

BACKGROUND OF INVENTION—OBJECTS AND ADVANTAGES

Accordingly, besides the other objects and advantages that will become apparent, the main objective of the present invention is to provide a continuous casting method and apparatus that promotes negative segregation without the consequence of positive segregation of the interior as the steel solidifies resulting in higher quality steel with minimal inclusions. Producing an equal axial fine grained crystalline structure being consistent chemically and physically, having excellent qualities such as: tensile strength, modulus of elasticity, toughness, ductility, workability, etc. Furthermore, the process described below has the object to reduce the cost for a superior nucleation agent, reduce the cost of decarbonization and deoxidization materials for producing a high quality steel void of oxidation point defects. The process also provides flexibility in casting dimensions, both width and thickness, thus reducing the operational and tool cost for producing a wider range of products and lowering the energy required for rolling reduction of the steel.

Continuous casting with the Sealed Table Caster promotes negative segregation without advancing positive segregation in the center of the casting. Furthermore this enhances the bonding in the grain boundaries by minimizing impurities in the grain boundaries that weakens grain bonding. Moreover, the grain bonding is increased by the multiplicity of the degree of increasing the fine equal axial granules. Still further objects and advantages will become apparent from a consideration of the ensuing description and drawings.

SUMMARY

It has been recognized that it would be advantageous to develop a continuous casting system that promotes negative segregation throughout the solidifying process resulting in a higher quality steel with a higher yield essentially eliminating inclusions in the steel. In addition, it would be advantageous to promote fine grain granules of equal axial dimensions to create greater bonding between granule structures.

Briefly, and in general terms, the invention is directed to a sealed table caster. The sealed table caster has a chamber with an opening, to allow a liquid to flow into the chamber. A cooling belt running along the bottom of the chamber causes the liquid to solidify while maintaining a layer of liquid on top of the solidified portion of the liquid. The belt moves the solidified steel toward the exit of the chamber and the liquid is poured into the chamber such that it causes the liquid steel to circulate on the solidified steel. As the liquid solidifies the impurities migrate into the liquid leaving a solid with excellent properties. In addition, a cooled roller with the sealing roll both equipped with a scraper that may be placed on top of the liquid to remove rejected impurities floating on the top layer of the liquid steel.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 1:
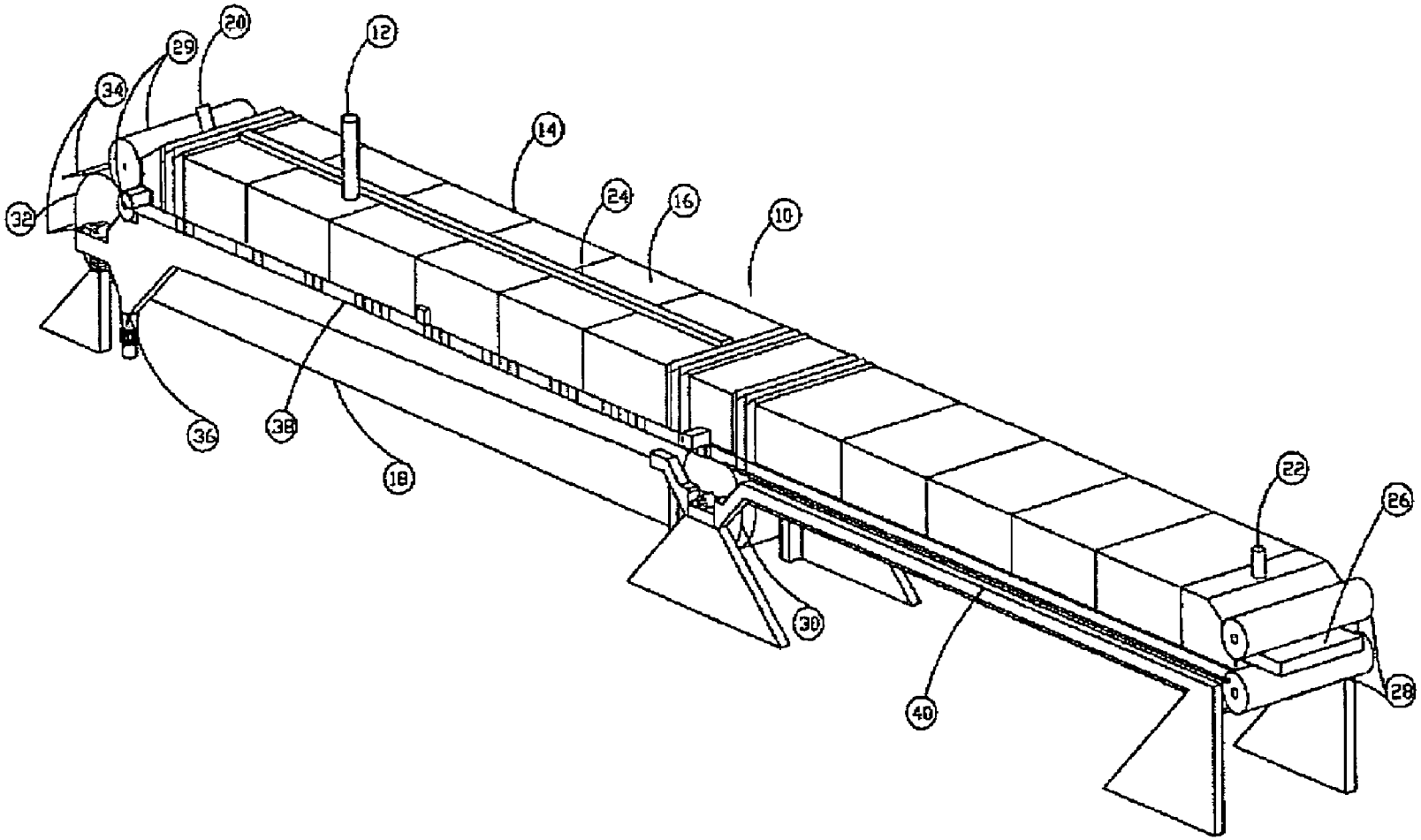
FIG. 1 is a perspective view of a table caster in accordance with an embodiment of the present invention.

In accordance with FIG. 1 the horizontal table caster 10 has a receiving tube 12 connected to a tundish (not shown). Typical materials used in casting can be used in constructing the horizontal table caster and such materials are well known in the art. The top of the table caster 10 has removable hood 14. The hood 14 creates a sealed chamber 16 around cooling belt 18. Chamber 16 can be any shape as long as it provides a seal around belt 18. It is preferable for belt 18 to be made of copper but any suitable material can be used. Gas inlet 20 allows a gas to enter chamber 16, creating a protective and cooling gaseous atmosphere and gas outlet 22 allows the gas to exit the chamber 16. The protective gas maintains an ideal gas coverage over the molten metal, gas free of harmful vapor. The gas can be a reducing or an inert gas such as carbon monoxide, carbon dioxide or argon. Hood 14 is cooled by water duct 24. Duct 24 receives and discharges water from a pressurized water source (not shown). The exit 26 (for the cast metal) of chamber 16 is sealed by two pinch sealing rolls 28. The rolls 28 keep gas from escaping chamber 16 while allowing the solidified steel to exit and assist in the constant movement of the solid steel. Chamber 16 is sealed on the opposite end by sealing rolls 29.

Belt 18 is driven by drive drum 30 and rotates around idler drum 32. Belt scrapers 34 touches sealing rolls 29 and belt 18. Drains 36 allow cooling water to exit the table and are provided with a gas seal (not shown). Pouring table 38 supports the cooling fountain which in turn supports the cooling belt and steel. Normalizing table 40 supports the steel during and after heat extraction has occurred and solidification and normalization is becoming completed.

Figure 2:
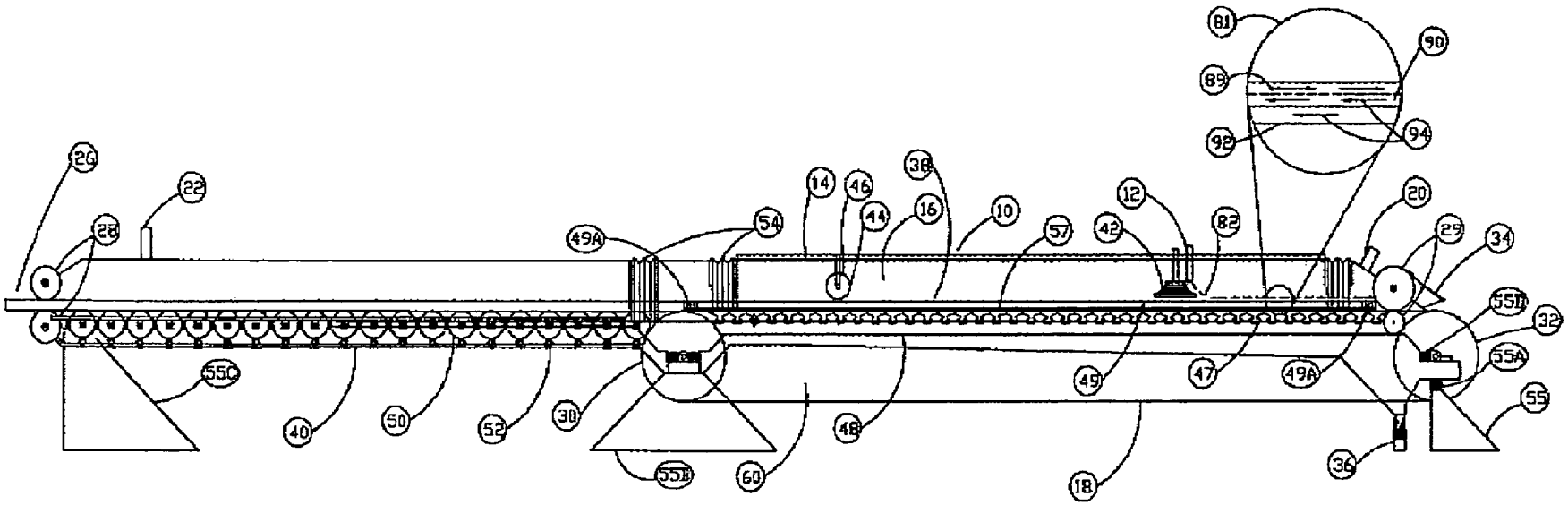
FIG. 2 is a cross-sectional view of the table caster

FIG. 2 shows a cross section of the sealed casting table 10. Circular deflector 42 is supported and rotated by an apparatus (not shown) and located down stream from tube 12. Deflector 42 is made of a ceramic but it can be made of any suitable material. Optional cooling roller 44 rotates in a direction opposite the direction of belt 18. Roller 44 is cooled by a pressurized water source (not shown) and cleaned by drum scraper 46. Cooling fountains 47 and belt 18 are supported by structural water boxes 48. Adjustable cooling walls 49 are located on either side and above belt 18. Walls 49 are adjusted with envelope holding arms 49A. Water boxes 57 are connected to a pressurized water source (not shown).

Normalizing table 40 consist of rollers 50 and base rollers 52. Base rollers 52 are connected to bottom of table 40 and support rollers 50. Expansion joint 54 connects the pouring table 38 to normalizing table 40. The table caster 10 is supported by jack pedestal 55, jack 55A, and supports 55B and 55C. Table caster is adjusted with tension jack 55D.

Blow up 81 shows a magnified view of table caster 10. Liquid steel 82 consists of two parts, upper portion 89 and lower portion 90. The liquid steel is located above the solidified steel 92. Flow arrows 94 show how upper and lower portions 89 and 90 moves in relation to the solidified steel 92.

Figure 3:
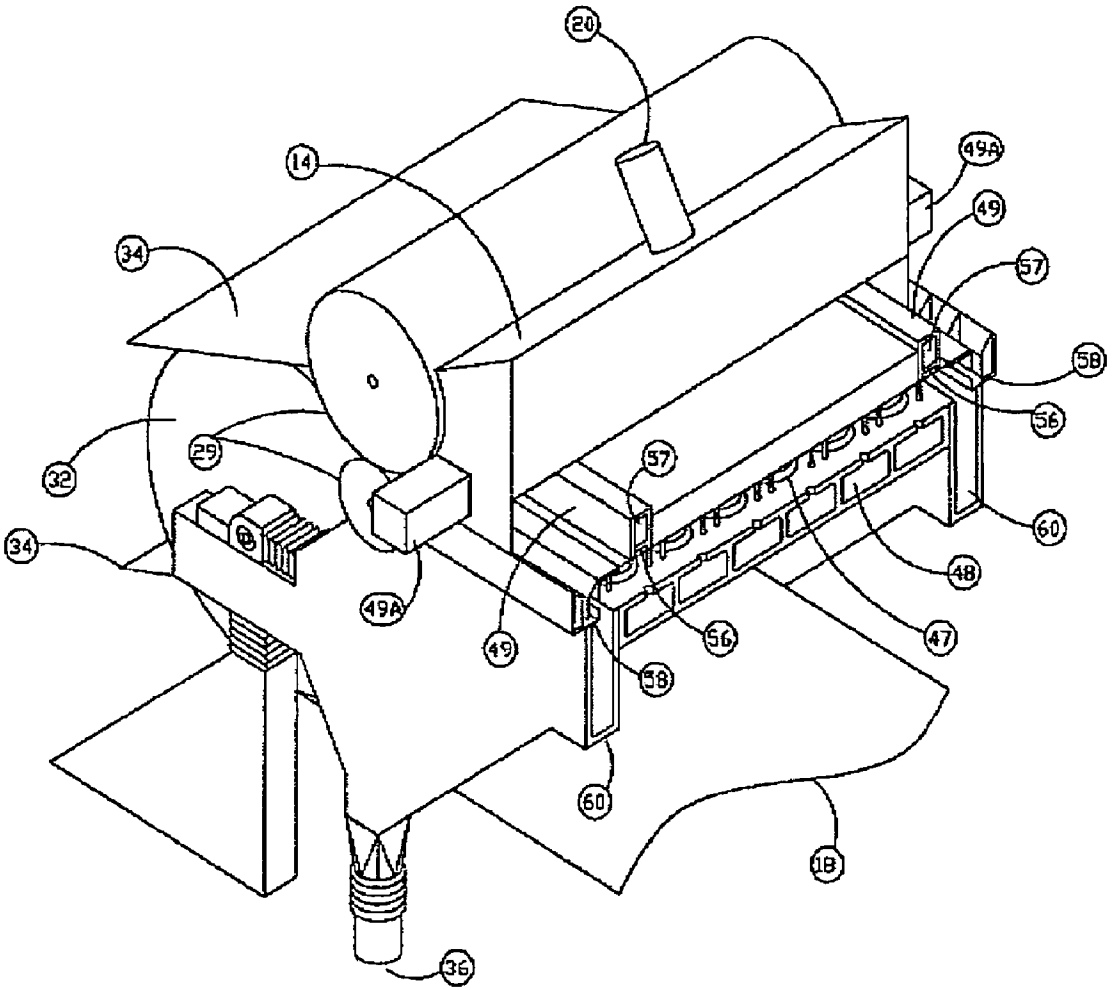
FIG. 3 is a perspective view and traverse section of the beginning section of the table caster

FIG. 3 illustrates a perspective cut section of one end of the horizontal table caster. Walls 49 are adjusted with arms 49A. The bottom of cooled side walls 49 has gas sealing canal 56. Pressurized gas fills gas sealing canal 56 to prevent leakage of molten metal under the cooled side wall 49. Cooled side wall 49 has water canal 57 which is connected to a pressurized water source (not shown). Water passes through water canal 57 to maintain cooled side wall 49 at a temperature well below boiling point. The hood 14 is supported on canal 58. Canal 58 is filled with runoff water to create a gas seal for chamber 16. Used cooling water flows into sluice trough 60 and out drain 36. Cooling water also flows over hood 14 and is supplied by conduit 24. Cooling water flows over hood 14 through conduit 24.

Figure 4:
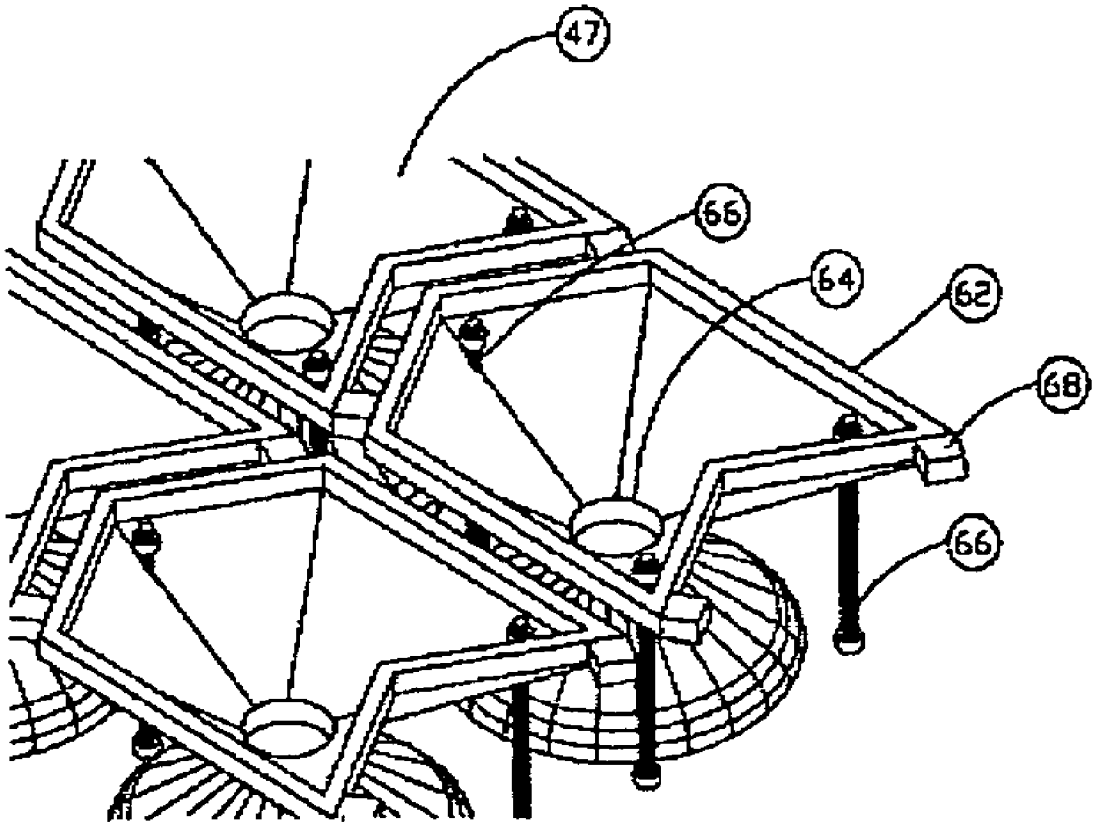
FIG. 4 is a perspective view of cooling fountains

FIG. 4 shows a perspective view of cooling fountains 47. Belt 18 (not shown) is supported by hydraulic pressure and floats on incoming water that flows though control orifice 64 and over rim 62. Water flows to the underside of cooling belt 18 (not shown) through flow control orifice 64. Bolts 66 provide support and anchor the cooling fountain 47 to water boxes 48 (not shown). Spacer 68 aligns adjacent cooling fountains together.

Figure 5:
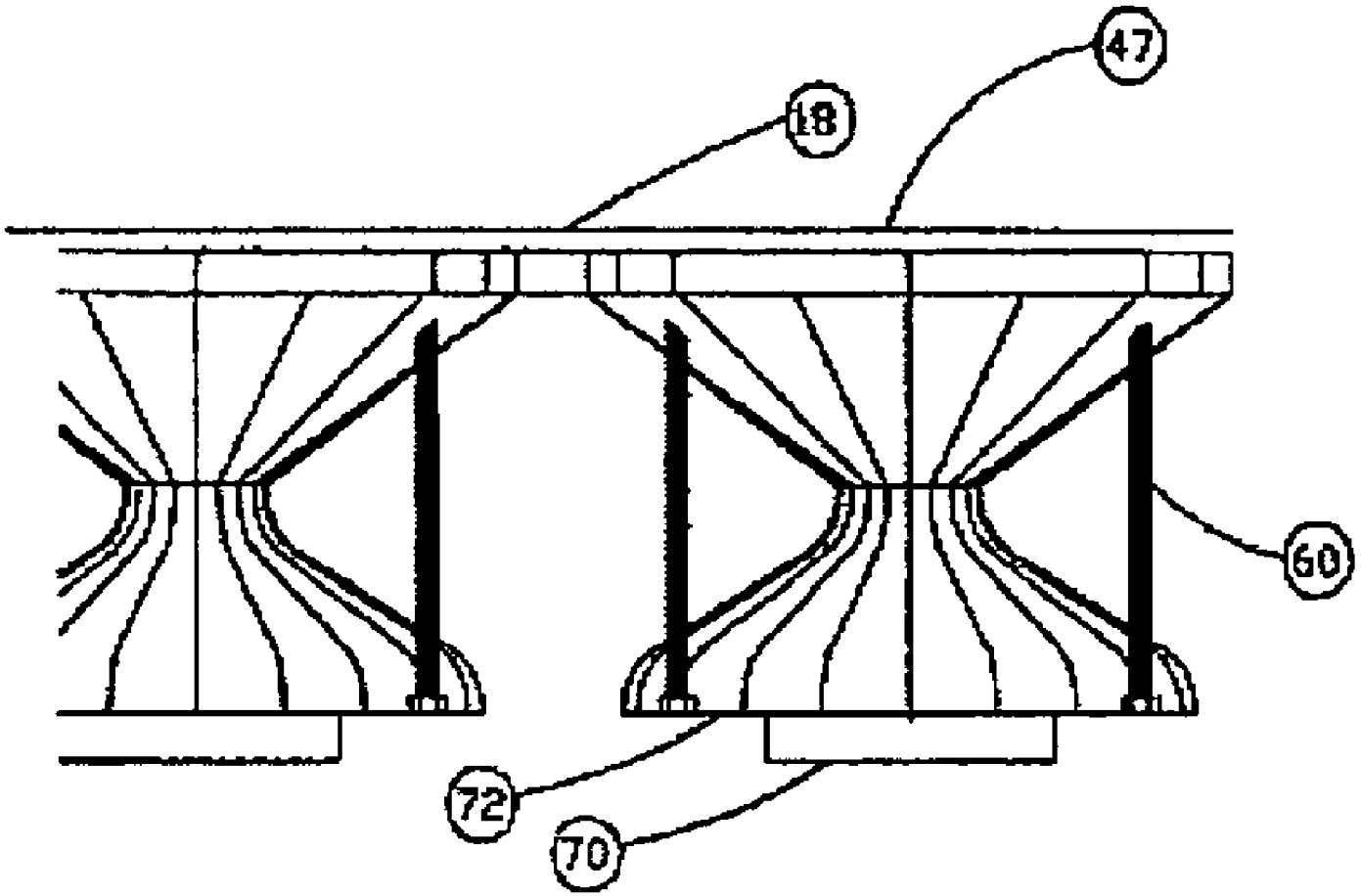
FIG. 5 is a side view of a cooling function.

FIG. 5 shows a side view of a cooling fountain 47. Alignment nipple 70 is used to set the cooling fountain in structural water boxes 48 (not shown). Sealing ring 72 provides a water tight seal between the cooling fountain and the structural water boxes.

Figure 6:
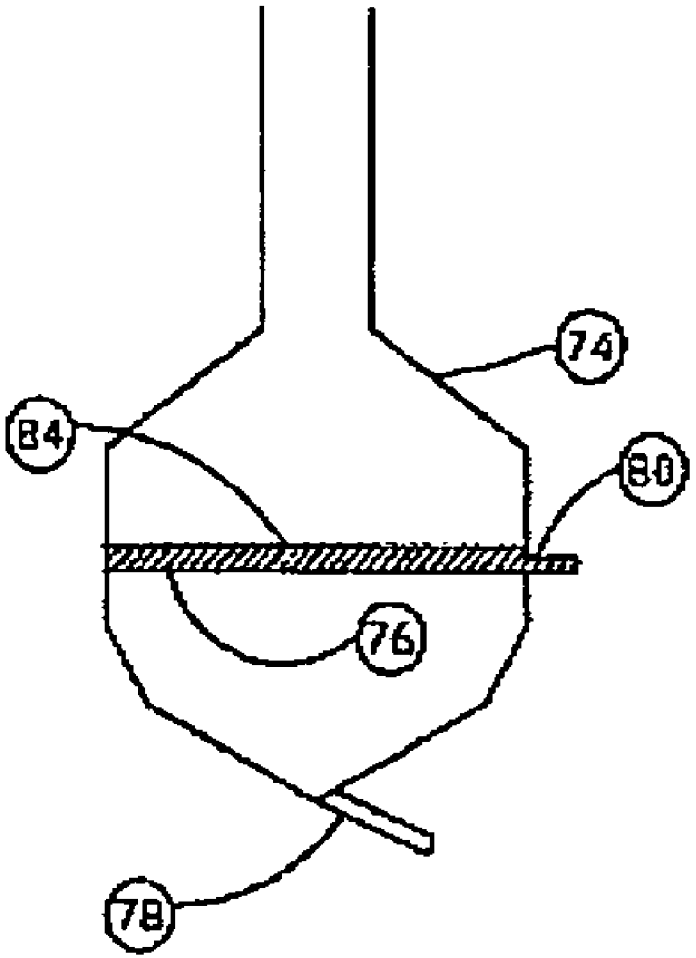
FIG. 6 is a high temperature reactor.
Figure 7:
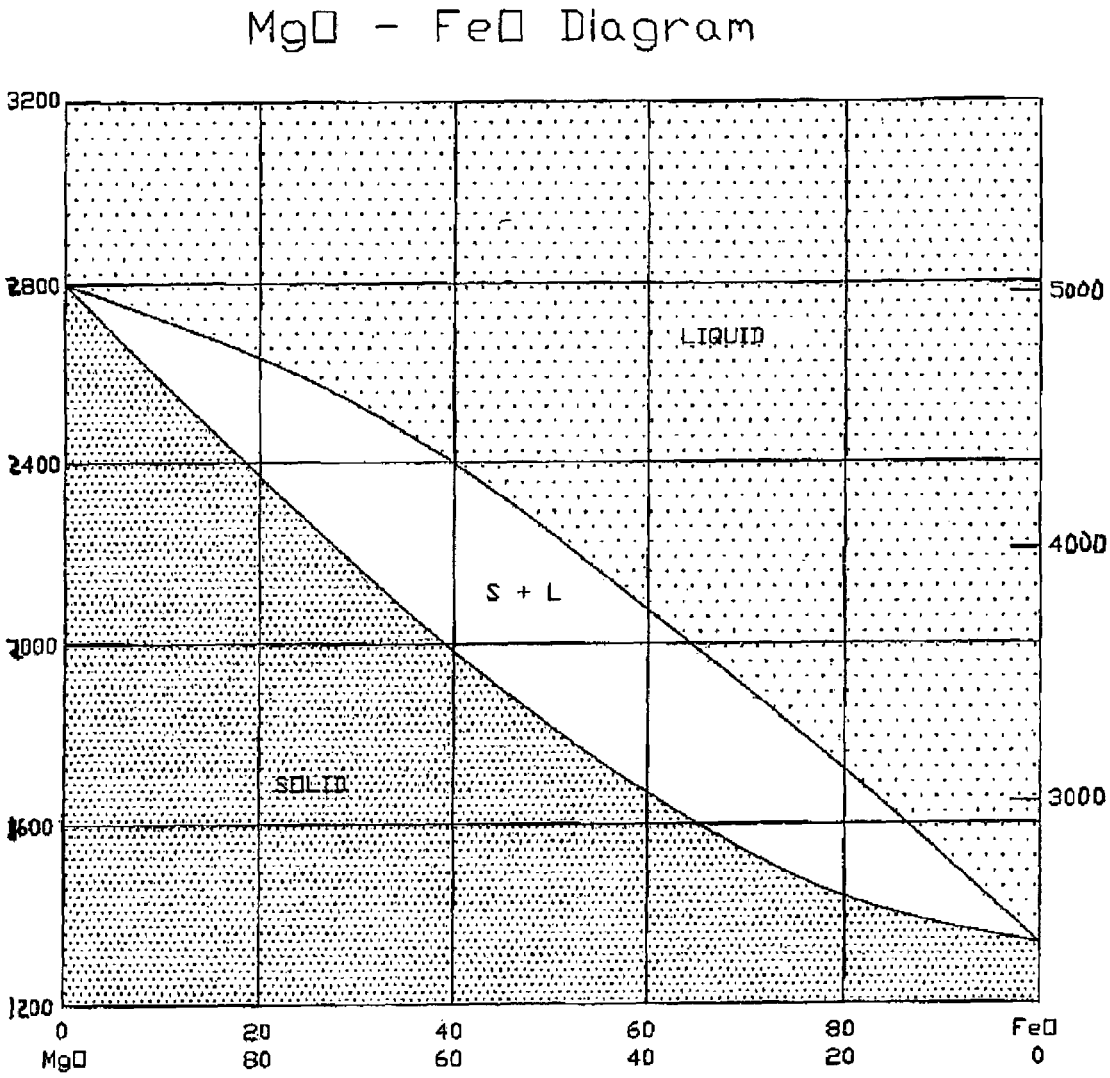
FIG. 7 is a phase diagram of the solubility of magnesium oxide with iron oxide.

FIG. 6 is the high temperature reactor 74 described in patent application Ser. No. 11/070,527 filed Mar. 1, 2005, by Oren V. Peterson, entitled "Thermal Synthesis Production of Steel" FIG. 1. The liquid metal 76 flows out port 78 into a ladle (not shown). Tap hole 80 can be used to drain the slag bath 84 on top of the liquid metal bath.

Operation—FIG. 2, FIG. 6, FIG. 7, and FIG. 8

The manner for using the horizontal table caster 10 is a follows. Liquid steel is prepared by the process as described in patent application Ser. No. 11/070,527 filed Mar. 1, 2005, by Oren V. Peterson, entitled "Thermal Synthesis Production of Steel" and as further processed as herein described. The phosphorus in the heat of the steel is oxidized to phosphorus pentoxide with the iron oxide in the metallic bath and rises up into the slag bath as the on going partial reduction process proceeds. Carbon is added on top of the slag bath near the final stage of iron partial reduction of the heat of steel to remove the phosphorus pentoxide, by reduction and evaporation, from the slag bath, the slag 84 is drained off through tap hole 80 after the phosphorus removal is completed. Iron oxide and powdered magnesium oxide are then added to the bath. The iron oxide and magnesium oxide go into solution in the partially reduced metallic bath at temperatures above 2300 degree Fahrenheit (See FIG. 7). Magnesium oxide has a simple cubicle crystalline structure. The magnesium oxide melting temperature is 5070 degrees Fahrenheit and iron oxide is 2300 degrees Fahrenheit, both are ionic bonds with the same valence so the iron oxide can substitute the magnesium oxide ion in the crystal structure allowing the magnesium oxide to go into solution both as liquid and suspended solid particles. The degree of solubility of magnesium oxide and iron oxide increase as temperature increases, thus the metallic bath temperature is now elevated. Once the degree of magnesium oxide is in solution with the iron oxide in the metallic bath, alloying materials and excess amounts of carbon are added into the solution and the carbon reacts with iron oxides in the solution. Excess amounts of carbon are added to reduce all metal oxides except the magnesium oxide, which is very chemically stable. Because the carbon deoxidation reaction is endothermic, carbon becomes an excellent deoxidation agent as metallic temperatures are increase. As a gas, the carbon oxides escape from the metallic bath leaving the iron, carbon and magnesium oxide and alloying materials in the solution. Because of the mass action of the excess carbon and carbon monoxide this process leaves the molten metallic bath near void of oxygen, other than the magnesium oxide nuclei which is chemically stable and serves as a solid nucleation agent.

The excess carbon can be removed by decarbonization. Decarbonization is the process of removing excess carbon by injecting carbon dioxide into the high temperature metallic bath. The carbon dioxide reacts with the carbon, at elevated temperatures, forming carbon monoxide and lowering the temperature of the metallic bath to casting temperature. This reaction removes the excess carbon from the metallic bath without oxidizing the iron. The magnesium oxide remains in the bath as nano-dimensional suspended solid particles that may serve as nuclei during solidification.

The metallic bath flows out of the reactor and into a ladle and then is poured into a tundish. The liquid exits the tundish and enters chamber 16 through tube 12. Circular deflector 42 deflects the vertical flow of the liquid steel 82 into a fanned horizontal flow directed in the opposite direction of travel of belt 18. The addition of molten steel being poured onto the surface of the pool of liquid steel causes the upper strata of liquid steel to flow towards the sealing roll 29, which is water cooled from the interior of the roll. The movement of cooling belt 18 and the flowing of the liquid steel into chamber 16 causes liquid portion of the steel to counter flow in strata on top of the solidified portion of the steel. The lower liquid portion of the steel 90 moves faster, toward the sealing rolls 28 than the solid portion of the steel 92. This movement causes developing dendrite to break off at the ends, minimizing columnar structural granules in the steel and creating dendrite nuclei. The rate of flow of the liquid steel 82 into chamber 16, the temperature of cooling belt 18, and the linear rate of the travel of the cooling belt 18 is coordinated such that a constant level of liquid steel is maintained in chamber 16. The depth of liquid steel can be varied to produce different slab thicknesses. The induced flow mixes the liquid steel on the cooling belt 18 with the poured hot steel 82, normalizing its temperature and insuring a uniformed solution, temperature, and solidification rate throughout the entire length of the casting and solidifying surface.

As the solidification proceeds from the cooling belt 18 to the surface of the liquid steel, fine granules of steel are forming, rejecting the impurities into the liquid steel. The fine granules form around the solid nano-dimensional magnesium oxide particles in the metallic bath solution. The liquid steel flows over the growing dendrite and breaks off the dendrite ends. This minimizes columnar growth, producing fragmented dendrite as nuclei, and carries the rejected impurities to the surface of the liquid steel. This rejection produces negative segregation resulting in minimal inclusions with a high purity of steel.

As the impurities are carried away by the flow of the steel, there is no subsequent positive segregation in the molten steel. Furthermore, as impurities are less dense than the liquid steel they float and remain at the surface of the liquid. The solidified steel travels longitudinal with the movement of the cooling belt 18. The dendrite continues to multiply around the magnesium oxide and fracture dendrite nuclei and grow into granules as the solidification increases in thickness as it moves toward the normalizing table 40. The impurities are allowed to escape to the surface of the liquid steel minimizing their presence in the grain boundaries as solidification proceeds. As the impurities are eliminated from the grain boundaries, bonding in the fine granule structure is increased. Cooling roller 44 contacts the top surface of the liquid steel. As the top layer of liquid (having the highest concentration of impurities) touches roller 44 it solidifies and sticks to the roller. Scraper 46 then removes the solidified slag or impurities from the roller 44 and is dispensed. It is recognized that the roller 44 and scraper 46 are optional. The upper surface of the casing, containing the impurities, may be scarified or ground to remove impurities.

Cooling belt 18 is supported by multiple cooling water fountains 47. The cooling water fountains maintain the cooling belt in an effective cooling range of temperatures by flowing water (or any other suitable cooling agent) on the underside of the cooling belt 18. The discharged water flowing from the cooling fountains 47 is collected in sluice trough 60 and discharged through drains 36. In addition the liquid steel pool is contained by adjustable water cooled side walls 49. Adjusting the side walls allows different cast widths to be formed with the same casting table. The liquid steel is contained by seal rolls 29. The roll cleaning scraper 34 is used to keep the belt on idler drum 32 and sealing roll 29 free of metal debris or scabs.

As the steel moves off the cooling belt 18 it proceed or continues on rollers 50 toward pinch rollers 28. Back up rollers 52 supports the load of the steel as it moves across rollers 50. Expansion joint 54 are located above the drive drum 30 to allow for differential movement in the table caster 10. Expansion joint 54 allows for difference in linear expansion of hood 14 and base 38. Sealing pinch rolls 28 allow the solidified steel to exit, to assist in the constant movement of the casting, and to keep gas from escaping.

From the above description the advantages of the horizontal casting table become evident:

(a) In the horizontal table caster solidification process proceeds from the bottom side of the steel surface, thus causing negative segregation to occur and proceeds traversal to the surface until the solidification process in complete, resulting in a superior casting of uniform steel with near complete segregation free of inclusions producing higher grades and yields.

(b) The adjustable cooling walls allow for different widths of steel to be cast from the same caster.

(c) The horizontal table caster allows for thinner and narrow castings of steel may maximizing the tonnage by producing longer castings.

(d) The use of natural occurring magnesium oxide instead of metallic magnesium is better because it leaves the final product free of iron oxide which is required to produce magnesium oxide nuclei with metallic magnesium and it is also less expensive.

(e) The use of magnesium oxide as a nucleation agent creates a finer grain steel with superior mechanical characteristics than steel using aluminum oxide as the nuclei. Natural occurring magnesium oxide produces much smaller nuclei than other nucleation agents such as aluminum oxide. It is also less expensive than metallic magnesium and aluminum. The magnesium oxide is a smaller nucleus than the aluminum and the columbic forces the reduced repulsion in its molecule enhances more rapid dendrite forming characteristics, resulting in finer equal axial grain steel.

(f) Excess carbon and carbon monoxide can be added to the metallic bath resulting in a complete reduction of iron oxide to metallic iron and carbon oxides enabling the formations of steel with fewer point defects.

(g) Carbon dioxide can be injected into the molten steel to oxidize excessive carbon, leaving near zero oxygen residue in the metallic bath, also being capable of lowering carbon to very low quantity for micro alloying. Adding oxygen to the metallic bath to remove the carbon will oxidize portion of the iron and requires large quantities of expensive deoxidizers to only partially reduce the residue of oxygen in the steel.

(h) The movement and flow of the liquid metal across and over the solidifying steel deters the growth of columnar grains and enhances the development of fine equal axial granule steel.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method for casting molten steel comprising the following steps:

(a) adding carbon to a slag bath to remove phosphorous pentoxide from the slag bath;

(b) removing the slag bath off a top layer of a partially reduced metallic bath;

(c) adding magnesium oxide and iron oxide to the partially reduced metallic bath;

(d) dissolving magnesium oxide in the partially reduced metallic bath causing the partially reduced metallic bath to contain an abundance of magnesium oxide;

(e) adding carbon to the partially reduced metallic bath;

(f) deoxidizing the partially reduced metallic bath with carbon into a metallic bath;

(g) injecting carbon dioxide into the metallic bath to decarbonize the metallic bath; and (h) lowering a temperature of the metallic bath to a casting temperature.

2. The method for casting molten steel in claim 1 where the partially reduced metallic bath is deoxidized with carbon monoxide.

3. The method for casting molten steel in claim 1, further comprising the steps of:

(i) placing the metallic bath in a chamber with a cooling belt along a bottom of the chamber the cooling belt having a temperature that will cause the metallic bath to solidify;

(j) removing the heat of fusion from a bottom side of the metallic bath;

(k) solidifying a portion of the metallic bath commencing from one side producing a solidified metal on a top portion the belt with the metallic bath on a top portion of the solidified metal;

(l) moving a bottom portion of the metallic bath in a same direction as the solidified metal and at a faster rate than the solidified metal;

(m) moving a top portion of the metallic bath in the opposite direction of the solidified metal;

(n) allowing the metallic bath to completely solidify with impurities remaining on top of the solidified metal; and (o) removing the solidified metal from the chamber.

* * * * *